US008464420B2

(12) United States Patent
Ye

(10) Patent No.: US 8,464,420 B2
(45) Date of Patent: Jun. 18, 2013

(54) STRUCTURE FOR INSTALLING SPLIT-STYLE DIAMOND GRINDING DISK

(75) Inventor: Hongyu Ye, Wuhan (CN)

(73) Assignee: Wuhan Wan Bang Laser Diamond Tools Co., Ltd., Wuhan (CN)

( * ) Notice: Subject to any disclaimer, the term of this patent is extended or adjusted under 35 U.S.C. 154(b) by 406 days.

(21) Appl. No.: 12/791,981

(22) Filed: Jun. 2, 2010

(65) Prior Publication Data

US 2011/0167626 A1 Jul. 14, 2011

(30) Foreign Application Priority Data

Jan. 12, 2010 (CN) ..... 2010 1 0028965

(51) Int. Cl.
*B23P 19/04* (2006.01)
*B23P 19/00* (2006.01)

(52) U.S. Cl.
USPC ..... 29/700; 29/253; 29/244; 451/264; 451/290

(58) Field of Classification Search
USPC ..... 29/244, 253, 700; 451/264, 290, 451/342–344, 359–360, 363, 540, 548, 353, 451/508, 510; 125/36, 39
See application file for complete search history.

(56) References Cited

U.S. PATENT DOCUMENTS

| | | | | |
|---|---|---|---|---|
| 4,998,384 | A * | 3/1991 | Bouchard et al. | 451/342 |
| 5,927,264 | A * | 7/1999 | Worley | 125/36 |
| 6,231,432 | B1 * | 5/2001 | Peterson et al. | 451/350 |
| 6,263,605 | B1 * | 7/2001 | Vanell | 451/443 |
| 7,137,875 | B2 * | 11/2006 | Jeansson | 451/350 |
| 7,147,548 | B1 * | 12/2006 | Mehrabi | 451/323 |
| 7,713,109 | B2 * | 5/2010 | Estes | 451/56 |
| 2007/0254568 | A1 * | 11/2007 | Park | 451/548 |
| 2008/0176498 | A1 * | 7/2008 | Rossi et al. | 451/508 |
| 2010/0087125 | A1 * | 4/2010 | Ohnishi | 451/67 |

* cited by examiner

*Primary Examiner* — Brian Glessner
*Assistant Examiner* — Beth Stephan
(74) *Attorney, Agent, or Firm* — Matthias Scholl P.C.; Matthias Scholl

(57) ABSTRACT

A structure for installing a split style diamond disk, having a fixing plate, a spring press plate, a connection plate, and a plurality of fast installation grinding blocks. The spring press plate is fixed to the fixing plate through screws with springs sleeved thereon, and the connection plate runs through the spring press plate and connects with the fixing plate by screws. The fixing plate has a plurality of L-shaped grooves provided therein, through which the fast installation grinding blocks are mounted on the fixing plate. The fast installation structure is mounted on an equipment shaft through the connection plate. The structure improves the capacity utilization and work efficiency of the grinding blocks.

10 Claims, 6 Drawing Sheets

STRUCTURE FOR INSTALLING SPLIT-STYLE DIAMOND GRINDING DISK

CROSS-REFERENCE TO RELATED APPLICATIONS

Pursuant to 35 U.S.C. §119 and the Paris Convention Treaty, this application claims the benefit of Chinese Patent Application No. 20100028965.3 filed Jan. 12, 2010, the contents of which are incorporated herein by reference.

BACKGROUND OF THE INVENTION

1. Field of the Invention

The invention relates to a diamond disk used for plane grinding of nonmetal materials, and more particularly to a structure for installing a split-style diamond grind disk which can be quickly installed and disassembled and has a low cost.

2. Description of the Related Art

Conventional diamond disks are generally an integrated product which consists of a steel base and a diamond segment. An integral disk is usually manufactured by a conventional method in which the diamond segment is welded to the steel base, and the grinding operation of the disk is accomplished by the diamond segment. After the diamond segment is consumed, the integral diamond disk is out of run, resulting in low capacity utilization and high cost. Conventional integral diamond disks are fixed to an equipment shaft via screws and have disadvantages of slow installation and disassembly speed and inconvenient use, which directly affect the work efficiency of the disk.

SUMMARY OF THE INVENTION

Accordingly, in view of the above-described problems, it is one objective of the invention to provide a structure for installing a split-style diamond grind disk which can be quickly installed and disassembled and has low cost, and thereby the capacity utilization and work efficiency of the disk are improved.

To achieve the above-mentioned objective, in accordance with one embodiment of the invention, there is provided a structure for installing a split-style diamond grind disk comprising a fixing plate, a spring press plate, a connection plate, and a plurality of fast installation grinding blocks; the spring press plate is fixed to the fixing plate through screws with springs sleeved thereon; the connection plate runs through the spring press plate and connects with the fixing plate by screws; the fixing plate has a plurality of L-shaped grooves provided therein, through which the fast installation grinding blocks are disposed on the fixing plate; and the whole fast installation structure is mounted on an equipment shaft through the connection plate.

The fast installation grinding blocks are disposed by aligning the fast installation grinding blocks with the corresponding L-shaped grooves in the fixing plate and pressing them into the L-shaped grooves so as to make the spring press plate to compress the springs sleeved on the screws to form a gap, so that the fast installation grinding blocks run through the L-shaped grooves in the fixing plate and push the fast installation grinding blocks outwardly to their work positions. The spring press plate presses against the fast installation grinding blocks to fix them after returning to the original position thereof.

In a class of this embodiment, there are four screws with springs sleeved thereon which connect the spring press plate with the fixing plate and four screws connecting the connection plate with the fixing plate, and they are distributed evenly.

In a class of this embodiment, the screws with springs sleeved thereon which connect the spring press plate with the fixing plate and the screws connecting the connection plate with the fixing plate are countersunk head screws.

Advantages of the present invention are summarized below. According to the characteristics of diamond disks, the invention uses the spring press plate and special L-shaped grooves to achieve a quick installation and disassembly of the grinding blocks. If the diamond segment is abrased, the grinding blocks can be replaced while the disk can be used repeatedly so that the work efficiency and capacity utilization of the disk is improved and, in turn, the consumption of steel and the cost is reduced.

BRIEF DESCRIPTION OF THE DRAWINGS

The invention is described hereinbelow with reference to accompanying drawings, in which.

DETAILED DESCRIPTION OF THE EMBODIMENTS

Figure 1:
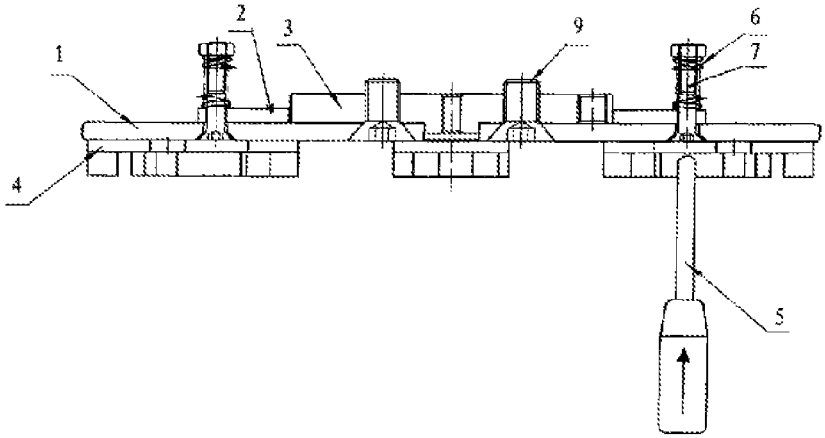
FIG. 1 is a schematic diagram of a fast installation structure of a split style diamond disk according to one embodiment of the invention.

For further illustrating the invention, experiments detailing a fast installation structure of a split style diamond disk are described below. It should be noted that the following examples are intended to describe and not to limit the invention.

The drawings disclose an embodiment of the present invention. In the drawings, the relations between reference numbers and the components are as follow: 1. a fixing plate of a fast installation grinding block; 2. a spring press plate of the fast installation grinding block; 3. a connection plate; 4. a fast installation grinding block; 5. a screwdriver; 6. a spring; 7. a screw with a spring sleeved thereon; 8. L-shaped grooves in the fixing plate; and 9. a screw through the connection plate and the fixing plate.

Figure 2:
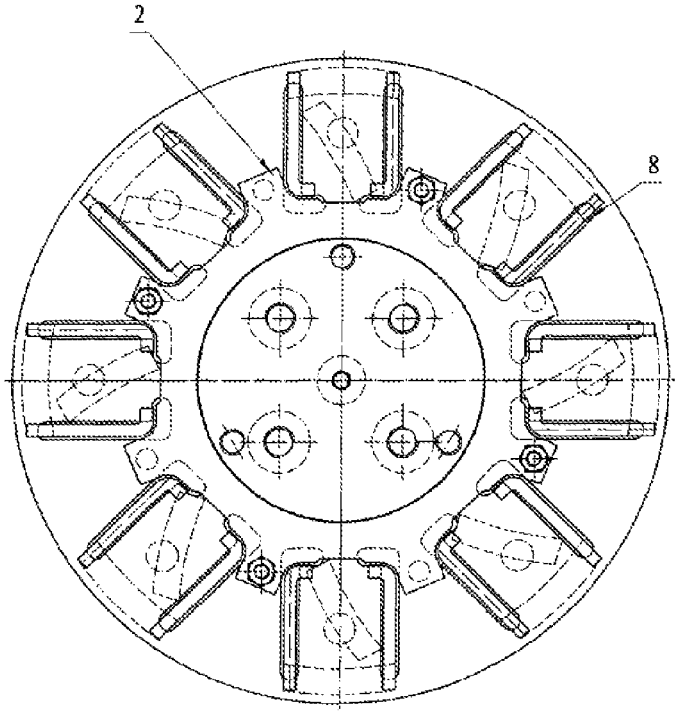
FIG. 2 is a top view of a fast installation structure of a split style diamond disk as shown in FIG. 1.
Figure 3:
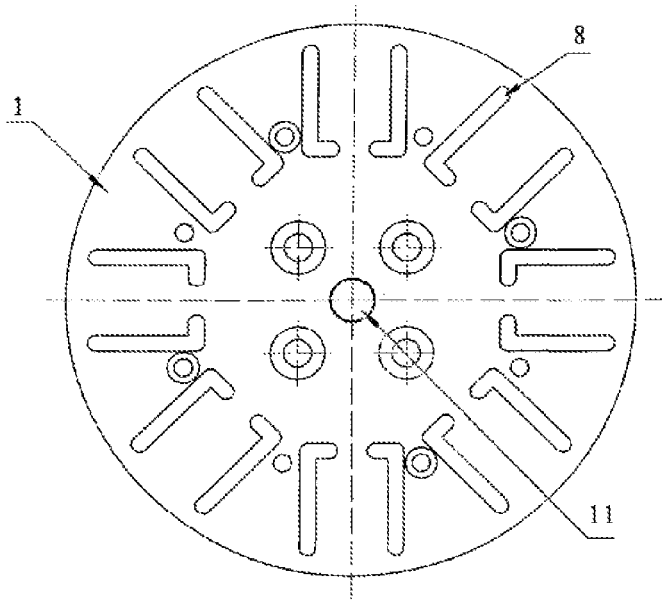
FIG. 3 is a schematic diagram of a fixing plate according to one embodiment of the invention.
Figure 4:
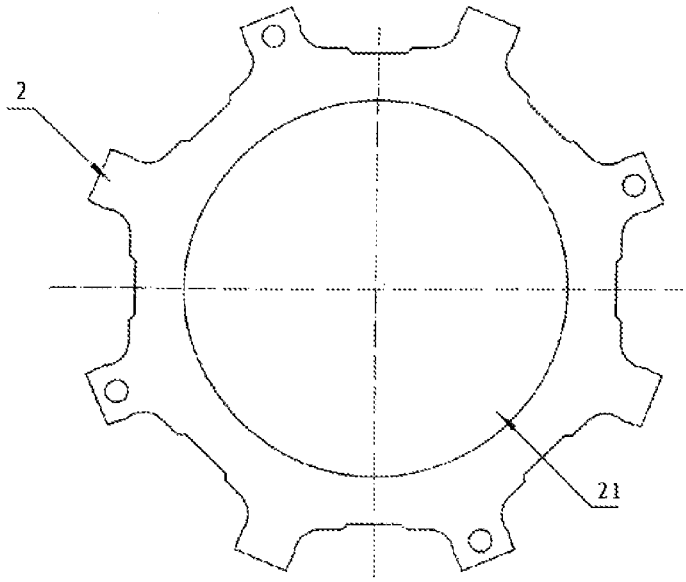
FIG. 4 is a schematic diagram of a spring press plate according to one embodiment of the invention.
Figure 5:
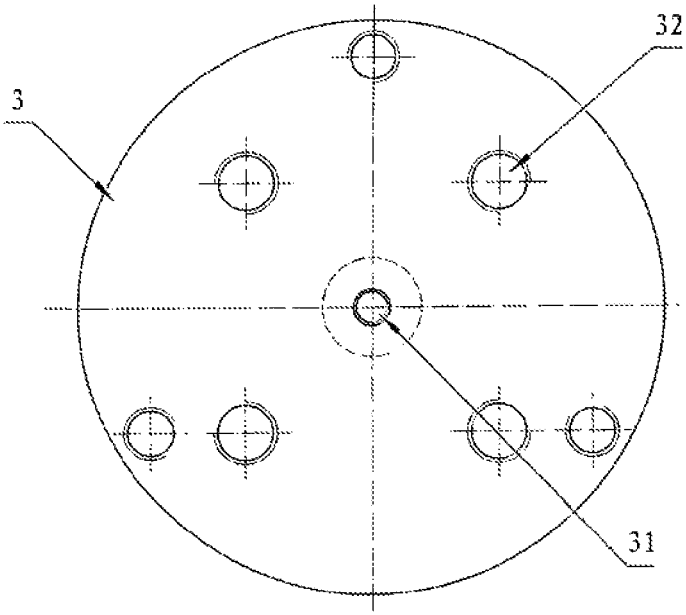
FIG. 5 is a schematic diagram of a connection plate according to one embodiment of the invention.
Figure 6:
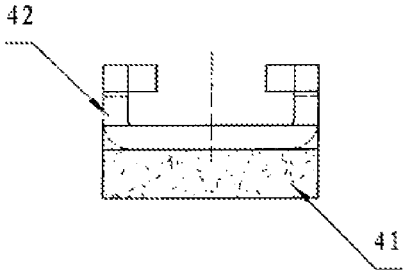
FIG. 6 is a schematic diagram of a fast installation grinding block according to one embodiment of the invention.
Figure 7:
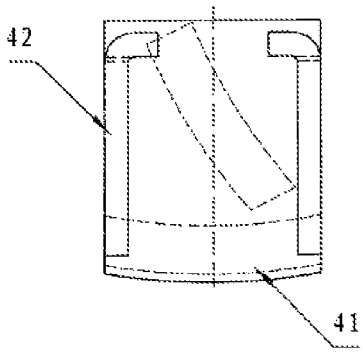
FIG. 7 is a top view of a fast installation grinding block as shown in FIG. 6.
Figure 8:
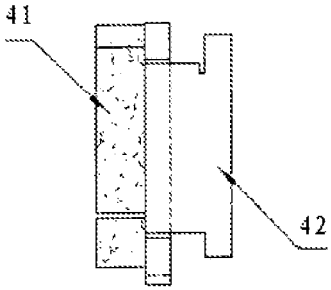
FIG. 8 is a side view of a fast installation grinding block as shown in FIG. 6.
Figure 9:
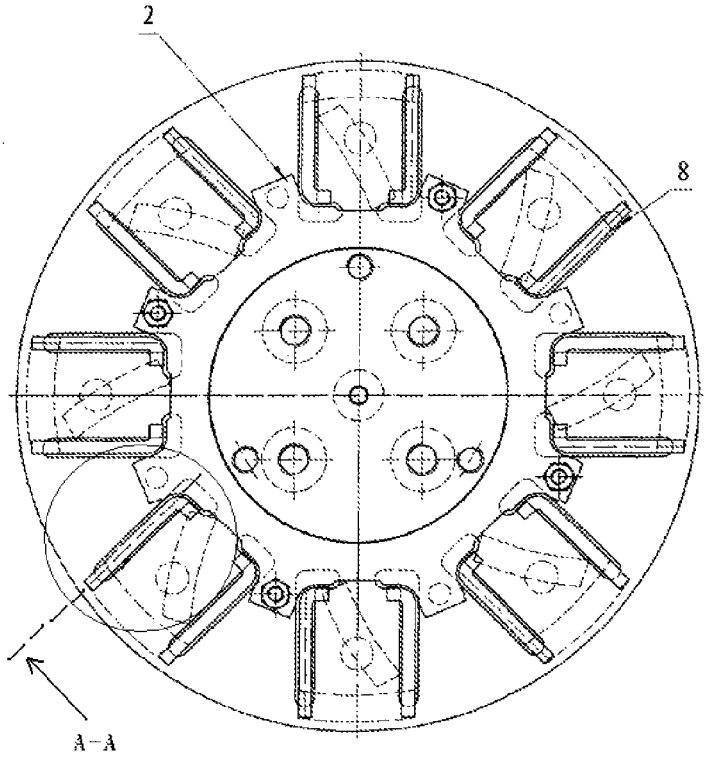
FIG. 9 is a top view of the diamond grinding disk shown in FIG. 1.
Figure 10A:
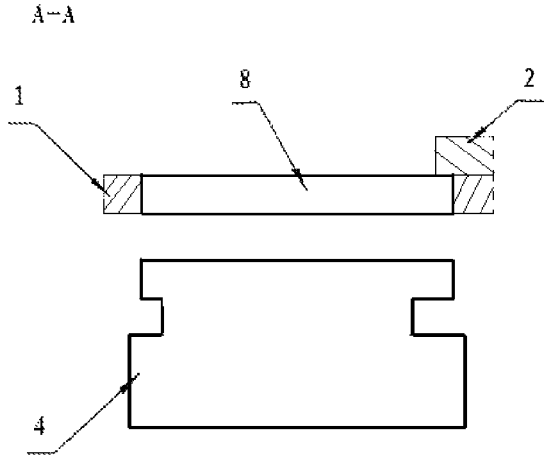
FIGS. 10(*a*)-10(*d*) are partial cross-sectional views of the diamond grinding disk shown in FIG. 9 along the A-A line, and show the process of mounting the grinding blocks 4 to the fixing plate 1.
Figure 10B:
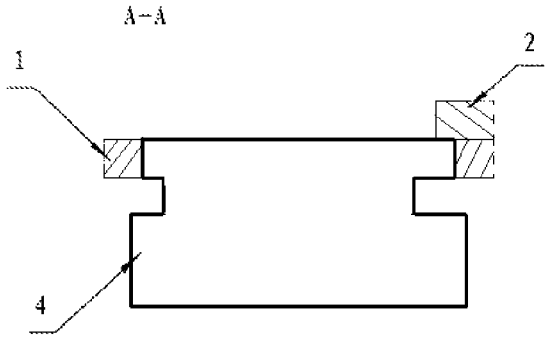
Figure 10C:
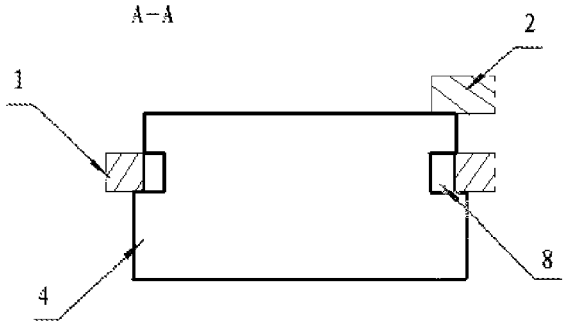
Figure 10D:
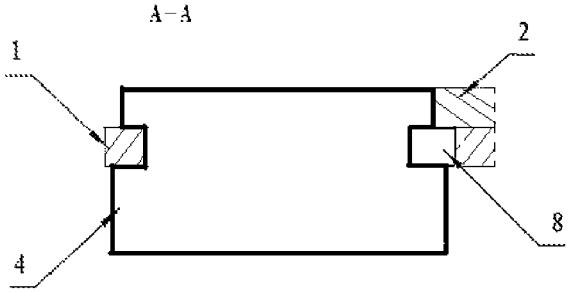

As shown in FIGS. 1 and 2, a spring press plate 2 having a center hole 21 is mounted on a fixing plate 1 through four screws 7 with springs 6 sleeved thereon. A connection plate 3 is disposed in the center hole 21 of the spring press plate 2, and is connected to the fixing plate 1 through four countersunk head screws 9 so as to form a fast installation structure fixed to an equipment shaft. In this structure, the combination of the fixing plate 1, the spring press plate 2 and the connection plate 3 is equivalent to the steel base of a conventional integral disk, and the fast installation grinding block 4 is equivalent to the diamond segment of the conventional integral disk.

The fixing plate 1 has special L-shaped 8 grooves formed therein, through which the fast installation grinding block 4 is fixed to the fixing plate 1. When assembling, the fast installation grinding block 4 is aligned with and pressed into the special L-shaped groove 8 in the fixing plate 1 so that the spring press plate 2 compresses the spring 6 sleeved on the screw 7 to form a gap and, in turn, the fast installation grinding block 4 runs through the L-shaped groove 8 in the fixing plate 1 and then the fast installation grinding block 4 is pushed outwardly to a work position. The spring press plate 2 will press against the fast installation grinding block 4 after its self-reset. When disassembling the fast installation grinding block, push the spring press plate 2 upwardly to form a gap with a screwdriver 5 and push the fast installation grinding block toward center of a circle so that the fast installation grinding block 4 can be dismounted. Thus, the fast installation structure of a split style diamond disk of the present invention is convenient for installation, disassembly, and usage.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A diamond grinding disk, comprising:

a fixing plate (1) having a plurality of L-shaped grooves (8) and a first center hole (11), a spring press plate (2) having a second center hole (21), a connection plate (3) having a third center hole (31) and a plurality of screw holes (32), a plurality of grinding blocks (4), each of said plurality of grinding blocks (4) having a base part (41) and a protruding part (42) extending from said base part (41), a plurality of springs (6), a plurality of first screws (7), and a plurality of second screws (9);

wherein:

said spring press plate (2) is disposed on said fixing plate (1) through said plurality of first screws (7) with said plurality of springs (6) sleeved thereon;

said connection plate (3) is disposed in said second center hole (21), and is connected to said fixing plate (1) through said plurality of second screws (9);

said protruding parts (42) project through said plurality of L-shaped grooves (8), whereby coupling said plurality of grinding blocks (4) to said fixing plate (1); and the diamond grinding disk is adapted to be mounted on an equipment shaft through said connection plate (3), wherein the equipment shaft is extended through said first center hole (11) and said third center hole (31), and is connected to the diamond grinding disk through said plurality of screw holes (32).

2. The diamond grinding disk of claim 1, wherein there are four of said plurality of first screws (7) with said plurality of springs (6) sleeved thereon which connect said spring press plate (2) with said fixing plate (1) and four of said plurality of second screws (9) connecting said connection plate (3) with said fixing plate (1), and they are distributed evenly.

3. The diamond grinding disk of claim 1, wherein said plurality of first screws (7) with said plurality of springs (6) sleeved thereon which connect said spring press plate (2) with said fixing plate (1) and said plurality of second screws (9) connecting said connection plate (3) with said fixing plate (1) are countersunk head screws.

4. The diamond grinding disk of claim 2, wherein said plurality of first screws (7) with said plurality of springs (6) sleeved thereon which connect said spring press plate (2) with said fixing plate (1) and said plurality of second screws (9) connecting said connection plate (3) with said fixing plate (1) are countersunk head screws.

5. The diamond grinding disk of claim 1, wherein said protruding part (42) comprises two parallel plates, each of said two parallel plates has a first corner, a second corner, a third corner, a square indentation, and a protrusion; and said first corner and said second corner are attached to said base part (41), said third corner is adjacent to said second corner, said square indentation is located at said first corner, and said protrusion is located on said third corner and is perpendicular to said two parallel plates.

6. A diamond grinding disk, comprising:

a plurality of grinding blocks (4), each of said plurality of grinding blocks (4) having a base part (41) and a protruding part (42) extending from said base part (41); and a base for receiving said plurality of grinding blocks (4), said base comprising a fixing plate (1) having a plurality of L-shaped grooves (8); a spring press plate (2) having a second center hole (21); a connection plate (3); a plurality of springs (6) having an upper end and a lower end opposite to said upper end; a plurality of first screws (7), each of said plurality of first screws (7) having a head; and a plurality of second screws (9);

wherein:

said spring press plate (2) is disposed on said fixing plate (1) through said first plurality of screws (7), and said head is disposed above said spring press plate (2);

said plurality of springs (6) are sleeved each on one of said first plurality of screws (7), said upper end is fixed to said head, and said lower end is in contact with said spring press plate (2);

said connection plate (3) is disposed in said second center hole (21), and is connected to said fixing plate (1) through said plurality of second screws (9); and said protruding parts (42) project through said plurality of L-shaped grooves (8) whereby coupling said plurality of grinding blocks (4) to said base.

7. The diamond grinding disk of claim 6, wherein:

said protruding part (42) comprises two parallel plates, each of said two parallel plates has a first corner, a second corner, a third corner, a square indentation, and a protrusion; and said first corner and said second corner are attached to said base part (41), said third corner is adjacent to said second corner, said square indentation is located at said first corner, and said protrusion is located on said third corner and is perpendicular to said parallel plates.

8. The diamond grinding disk of claim 6, wherein:

said fixing plate (1) further having a first center hole (11);

said connection plate (3) further having a third center hole (31) and a plurality of screw holes (32); and the diamond grinding disk is adapted to be mounted on an equipment shaft, wherein the equipment shaft is extended through said first center hole (11) and said third center hole (31), and is connected to the diamond grinding disk through said plurality of screw holes (32).

9. A base of a diamond grinding disk for receiving a plurality of grinding blocks, each of the plurality of grinding blocks comprising a base part and a protruding part extending from the base part, the base comprising:

a fixing plate (1) having a plurality of L-shaped grooves (8);

a spring press plate (2) having a second center hole (21);

a connection plate (3);

a plurality of springs (6), each of said springs (6) having an upper end and a lower end opposite to said upper end;

a plurality of first screws (7), each of said first screws (7) having a head; and a plurality of second screws (9);

wherein:

said spring press plate (2) is disposed on said fixing plate (1) through said first plurality of screws (7), and said head is disposed above said spring press plate (2);

said plurality of springs (6) are sleeved each on one of said first plurality of screws (7), said upper end is fixed to said head, and said lower end is in contact with said spring press plate (2); and said connection plate (3) is disposed in said second center hole (21), and is connected to said fixing plate (1) through said plurality of second screws (9);

when coupling the plurality of grinding blocks to the base, the protruding parts are inserted into said plurality of L-shaped grooves (8); and when uncoupling the plurality of grinding blocks from the base, the protruding parts are removed from said plurality of L-shaped grooves (8).

10. The base of claim 9, wherein:

said fixing plate (1) further having a first center hole (11);

said connection plate (3) further having a third center hole (31) and a plurality of screw holes (32); and the base is adapted to be mounted on an equipment shaft, wherein the equipment shaft is extended through said first center hole (11) and said third center hole (31), and is connected to the base through said plurality of screw holes (32).

* * * * *